US008434801B2

(12) United States Patent
LeBlanc

(10) Patent No.: US 8,434,801 B2
(45) Date of Patent: May 7, 2013

(54) FLANGE LIFTER DEVICE

(76) Inventor: Adam LeBlanc, DeQuincy, LA (US)

( * ) Notice: Subject to any disclaimer, the term of this patent is extended or adjusted under 35 U.S.C. 154(b) by 0 days.

(21) Appl. No.: 13/284,692

(22) Filed: Oct. 28, 2011

(65) Prior Publication Data

US 2012/0280521 A1 Nov. 8, 2012

Related U.S. Application Data

(60) Provisional application No. 61/481,492, filed on May 2, 2011.

(51) Int. Cl.
*B66C 1/28* (2006.01)
*B66C 1/62* (2006.01)

(52) U.S. Cl.
USPC ..... 294/82.13; 294/106

(58) Field of Classification Search ..... 294/67.31, 294/81.56, 82.1, 82.13, 85, 106, 110.1, 118, 294/902
See application file for complete search history.

(56) References Cited

U.S. PATENT DOCUMENTS 2,206,328 A * 7/1940 Martinek ..... 294/85
2,819,111 A * 1/1958 Cozzens ..... 294/26
3,164,406 A * 1/1965 Barry ..... 294/199
3,207,463 A * 9/1965 Downey ..... 248/339
3,337,256 A * 8/1967 Shropshire, Jr. ..... 294/82.1
3,649,062 A * 3/1972 Young, Jr. ..... 294/106
3,968,987 A * 7/1976 Powell ..... 294/82.11
4,221,419 A * 9/1980 Riley et al. ..... 294/106
4,530,536 A 7/1985 Williams
5,064,334 A 11/1991 Cooley
5,065,984 A 11/1991 Hake
5,344,207 A 9/1994 Grimm
5,842,729 A 12/1998 Bunn
6,053,550 A * 4/2000 Paterson ..... 294/81.56
6,581,996 B1 * 6/2003 Fromelius ..... 294/89
6,609,742 B1 * 8/2003 Macom et al. ..... 294/82.13

* cited by examiner

*Primary Examiner* — Dean Kramer
(74) *Attorney, Agent, or Firm* — Daniel Boudwin

(57) ABSTRACT

A pipe flange lifting device for supporting and leveling two holes of a blind flange during installation onto a pipe end. The device comprises two L-shaped claws connecting to a common pin, forming an overall triangular-shaped device having a crane hoist fitting. The claws are positioned on opposing sides of a pipe flange and rotate freely with respect to the pin prior to installation, whereafter the claws are fitted beneath lifting bolts fitted through a flange for stable support during operation. The lifting bolts comprise a pair of bolts inserted into eyes of the flange prior to the lifting operation. Spacers along the pin allow the claws to be separated by a desired distance and prevent pinch points due to claw inclination. The design of the claws provides stable support for two lift bolts of a pipe flange and assists in the installation process.

6 Claims, 3 Drawing Sheets

FLANGE LIFTER DEVICE

CROSS REFERENCE TO RELATED APPLICATION

This application claims the benefit of U.S. Provisional Application No. 61/841,492 filed on May 2, 2011, entitled "Big A Flange Lifter."

BACKGROUND OF THE INVENTION

1. Field of the Invention

The present invention relates to an improved means for lifting and rigging pipe flanges into position for bolting and welding during installation of a flange onto a pipe end. More specifically, the present invention pertains to a device for lifting medium to large pipe blind flanges into position for installation in a way that improves worker safety. The present invention eliminates the need to weld a lifting eye to the flange, saving time and resources and reducing the overall cost of installation of the flange.

2. Description of the Prior Art

Many industries utilize piping systems to facilitate daily operations. For example, oil refineries, gas companies and sewage treatment facilities need to pump and store large volumes of gases and/or liquids. The transport and storage systems for these products are large and are designed for durability and safety, as a leak in one of these piping systems could be extremely hazardous. Typically, piping systems are welded together at various junctions and joints to prevent against leaks. Piping systems may comprise an array of individual components and assemblies. The present invention pertains specifically to pipe blind flange fittings, wherein its design is specifically suited therefor. These fittings are very heavy components that require specific techniques and safety precautions when installing. Their sheer size and weight necessitates the use of a mechanical lifting device, such as a crane or mechanical hoist, during their lifting and rigging into place during installation.

Blind flanges are flat, disk-like covers that affix over the ends of open pipes. They are often difficult to manipulate because of their weight and are challenging to lift and position because of their shape. A traditional procedure for lifting a flange involves welding a lifting eye onto the flange. The purpose of the lifting eye is to serve as a lift point for a crane hoist or other lifting apparatus, which is used to pick up the flange and suspend it while workers secure it to the pipe end assembly. The process is expensive and time consuming, as a worker must weld the lifting eye to the flange and then remove the lifting eye once the flange has been installed in the desired location. Another traditional procedure for lifting a flange involves inserting a chain through an eye of the flange and then using the chain to lift the flange. This method is highly hazardous to worker safety because any link of the chain could break and the flange could fall to the ground. There methods further do not provide the level of stability necessary for safe installation, as a chain or single lifting eye does not guarantee the device will not rotate while being positioned. This introduces a pinching risk for workers operating near the suspended flange and the pipe end, whereby clothing and limbs may be compressed therebetween if the flange is not statically supported. Worker safety and adequate precautions are paramount in such work environments and around construction sites, as accidents can lead to considerable injury to those involved.

There are many specialized devices that can facilitate the lifting of heavy industrial assembly components. For example, U.S. Pat. No. 4,530,536 to Williams describes a set of lifting tongs for use in conjunction with a crane for lifting I-beams. The device is designed for use by a single individual. The tongs are opened and closed by the operation of a pneumatic piston at the upper end of the set of tongs. A set of jaws exists at the lower ends of the tongs having a groove cut into the interior face of each jaw. The grooves are specifically designed to catch the edges of the top flange of an I-beam. A crane operator lowers the lifting tongs device around the sides of the beam that is to be lifted. The crane operator then operates the closing mechanism of the tongs. As the tongs close, the jaws come together to secure against the upper flange of the beam. The jaws are designed so that as the jaws are closing, if the crane operator slowly lifts the device with the crane hoist, the jaws catch the edges of the top flange of the beam within the jaw grooves.

The Williams device is particularly designed for the purpose of lifting I-beams. While the Williams device serves an important function by lifting such beams, the device could not be used for lifting blind flanges. The jaw and groove mechanism employed by the Williams device for catching the top edge flanges of an I-beam could not be used to grip the edges of a blind flange or support a pair of lifting bolts attached thereto, since the diameter of a blind flange is very likely to exceed the span of the top edge flanges of an I-beam and the tongs are not adapted to support the two bolts in a secure and stable manner.

U.S. Pat. No. 5,065,984 to Hake describes a clamp assembly device for lifting pins out of concrete forms. When concrete is poured, the outer edges of what is poured must be shaped into the desired form. A concrete form is typically a metal frame that is made from smaller segments of the form combined together to make the overall form of the concrete slab to be laid. The smaller portions of the frame fit together like puzzle pieces—connected to one another and held together via pins. The device attaches to a lifting mechanism, which can be a piece of industrial equipment that allows for an upward lifting element that facilitates lift needed when using the disclosed device. The lifting mechanism is important when using the Hake device properly as the pins must be removed from the concrete forms by pulling directly upward. Pulling the pins any direction other than vertically will damage the pin, the concrete form, or both. While suited for its particular requirement, the Hake device is limited to lifting concrete form pins. The present invention provides a lifting mechanism for use with a lifting mechanism, such as a crane or hoist, and is particularly suited for lifting pipe flanges into position for attachment onto a large pipe assembly or pipe end.

U.S. Pat. No. 5,344,207 to Grimm describes an apparatus for lifting tires that is used in conjunction with a lifting device, such as a crane. The device comprises two members for gripping a tire and a means for connecting to a crane. The first member is stationary, while the second member is movable. The second member has two positions: a tire lifting position and a tire non-lifting position. To use the device, a tire is placed between the two members when the second member of the device is in the non-lifting position. Once the tire is in properly placed in the device, the second member is moved by a user to the tire lifting position and locks into place so that the tire is gripped by the two members of the device.

Similar to the Grimm device is U.S. Pat. No. 5,064,334 to Cooley, wherein an apparatus for lifting large tractor tires is disclosed. The size of tractor tires makes them difficult to maneuver without the assistance of a lifting device. The Cooley device aims to lift and move tractor tires easily. When a tractor tire is standing upright on the tread, the Cooley device attaches to the tire by an attachment means. The tire attachment means connects to a boom, which is raised and lowered by a hand jack. The boom connects to a base and the boom is also capable of being pivotally rotatable to facilitate moving of the tractor tire from one point to another. One embodiment of the tire attachment means is a square-shaped clamp. The arms of the clamp extend around the sides of the tractor tire with the ends of the clamp arms wrapping under the rim of the tire so that when the clamp is closed around the tire, the tire is caught in the clamp. The boom can then be lifted, lifting the attached tractor tire with it by operating the hand jack.

Both the Grimm and Cooley devices are specifically suited for lifting tires. Each device employs a clamping mechanism is designed to grip, lift and suspend a tire. The clamping mechanisms of the Grimm and Cooley devices do not support the tire from below its structure in any way. The clamps merely pinch under the tire carcass such that the clamps encircle the sidewall and enter through the wheel opening. While it is unlikely, if the clamping mechanism of either the Grimm or Cooley devices were to fail, the tire would release or drop from the grip of the device. Such an accident could harm an individual or damage property. Not only is the present invention used for lifting blind flanges—and not tires—the present invention improves user safety in the event that the device where to fail. The claws of the present invention are designed to catch under a minimum or two lifting bolts inserted through eyes in a blind flange. Upstanding ends of both claws further prevent the flange from sliding from and end of the device. Since the present invention further employs the use of two claws and requires the claws catch a minimum of two lifting bolts during use, the safety redundancies incorporated into the present invention improve the overall safety of the device in operation should either one of the claws of the device, or one of the lifting bolts, fail.

U.S. Pat. No. 5,842,729 to Bunn describes a device for lifting large sections of heavy pipe. The device comprises a pair of lifting tongs that attach to a crane hoist or other lifting means. The tongs have two ends and are connected to each other at a pivot point. The bottom end of each tong curves inward towards the center of the tongs such that as the tongs close, they wrap around the cylindrical shape of the pipe cross section being moved. The top end of each tong connects to the other by a highly durable cable. The cable is looped through a lifting means, such as a crane hoist or a forklift. As the crane hoist or forklift rises, it pulls upward on the cable connecting the two top ends of the tongs, causing the top ends of the tongs to move towards one another. The tongs are positioned in a scissor configuration, wherein the cable action on the tongs compresses the working ends of the tongs around a pipe section. As the top ends of the tongs move towards each other, the bottom ends also compress towards each other, wrapping around the section of cylindrical piping. These tongs are not suited for adequately lifting or supporting lift bolts of a blind flange. The scissor action provides lateral compression but inadequate support under the flange bolts, which is necessary for safely and securely lifting a blind flange. The present invention provides a means to support a blind flange and lift bolts thereof in a secure and safety redundant manner.

The present invention provides a pair of rotatable, L-shaped claws that are rotatably connected and offset from one another via a common pin attachment. The claws are adapted to be placed under a pair of lift bolts inserted through fastener locations on a blind flange. The claws attached on either side of the flange and provide a support means that resists slippage or dislodgement of the claws while lifting. Spacers along the pins provide the offset between claws, and further prevent the claws from binding or creating pinch points along the pin. It is therefore submitted that the present invention substantially diverges in design elements from the prior art, and consequently it is clear that there is a need in the art for an improvement to existing flange lifting devices. In this regard, the instant invention substantially fulfills these needs.

SUMMARY OF THE INVENTION

In view of the foregoing disadvantages inherent in the known types of pipe flange lifting devices now present in the prior art, the present invention provides a new improved means of lifting and rigging pipe flanges wherein the same can be utilized for providing convenience and improved safety for workers during flange installation onto a pipe end.

It is therefore an object of the present invention to provide a new and improved lifting and rigging device for pipe flanges that has all of the advantages of the prior art and none of the disadvantages.

Another object of the present invention is to provides a flange lifting device having a first and second L-shaped claw adapted to safely and securely lift and support lifting bolts of a pipe flange, attachable to a lift, hoist or crane.

It is also an object of the present invention to improve the overall safety for workers handling pipe flanges by providing a device that stability supports a suspended pipe flange prior to installation.

Another object of the present invention is to provide a safe method for lifting a large blind, and one that does not require the additional step of first welding a lifting eye onto the assembly.

Yet another object of the present invention is to provide a means of lifting and rigging blind flanges of various flange thickness and bolt pitch.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
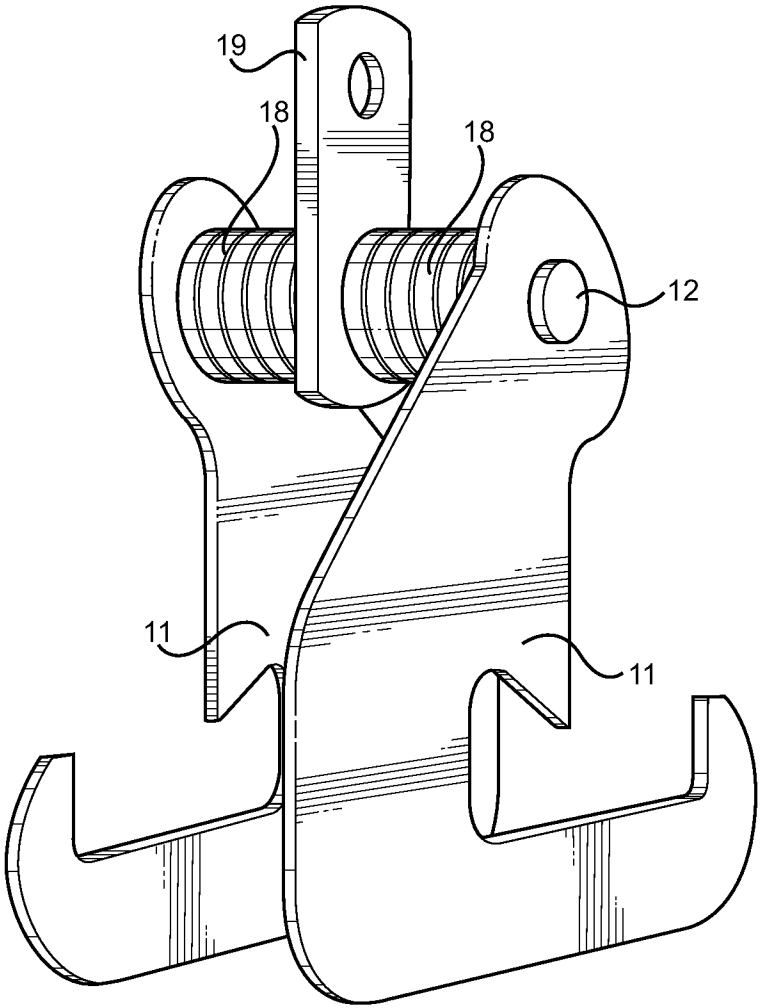
FIG. 2 is a frontal perspective view of an exemplary embodiment of the present invention.

Reference is made herein to the attached drawings. Like reference numerals are used throughout the drawings to depict like or similar elements of the pipe flange lifting device described as the present invention. For the purposes of presenting a brief and clear description of the present invention, the preferred embodiment will be discussed as used for lifting and rigging a blind flange into place onto a pipe end for fastening thereto. The figures are intended for representative purposes only and should not be considered to be limiting in any respect.

Figure 1:
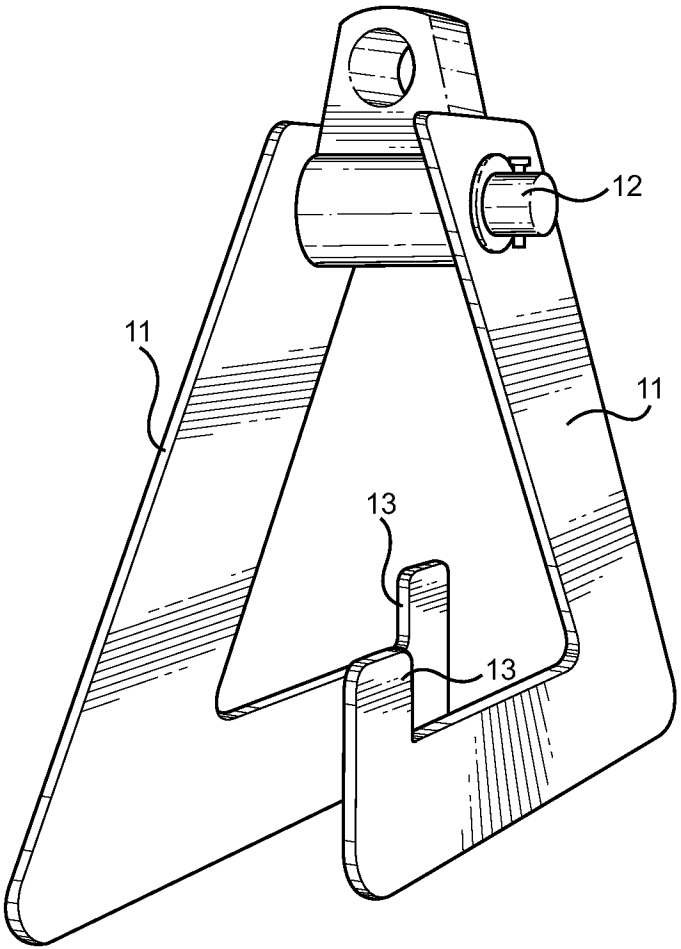
FIG. 1 is a frontal perspective view of a first embodiment of the present invention.

Referring now to FIG. 1, there is shown a perspective view of a first embodiment of the present invention. The device comprises a pipe flange lifting device for use in conjunction with a crane hoist for lifting and rigging large blind flanges during installation onto a pipe end. The pipe flange lifting device incorporates a pair of opposing claws. Each claw resembles a general L-shape with a horizontal bottom portion and diagonal portion. The claws 11 are free to pivotally rotate about a common pin 12 that connects and offsets each claw 11 a given distance. The distance of separation is used to fit the thickness of a flange work piece, wherein the claws are positioned on a first and second side of the flange. Along the top of the pin is equipped a crane hoist fitting. A crane hoist attaches to this fitting to lift the assembly and any supported flange. During operation, the horizontal portion of each claw is adapted to accept a pair of lifting bolts that are slotted through fastener holes, or eyes, long the perimeter of the flange. The lifting bolts are supported symmetrically on either side of the flange by the claws, providing a stable support for the flange while lifting and positioning the flange prior to installation.

The common pin 12 that connects the two claws together provides the claws 11 of the pipe flange lifting device with two configurations. The first configuration is an open configuration, wherein the claws 11 are free of the lifting bolts and are free to rotate with respect to the pin to achieve a desired positioned while fitting the device onto a pair of lifting bolts. The second configuration is a static configuration, where the device claws catch the lifting bolts of the flange in preparation for lifting the flange. A series of spacers along the pin, between the hoist point and the claw attachment location, provides for an offset between the claws 11 along the pin 12 for space to exist therebetween. This space between the claws is occupied by a portion of the blind flange during use. The spacers are utilized to prevent the claws from rotating inward or outward, which otherwise would create pinch points or bind the device.

The horizontal portion of each of the L-shaped claws has an upstanding lip 13 protruding at its terminal end, which forms a catch and a ledge along the horizontal portion for the lifting bolts to position themselves. The ledge extends from the inner angle of the claw to the lip 13. This area may be treated or coated with a durable material, such as high density rubber, for the purpose of preventing damage to the threads of the lifting bolts while supporting the lifting bolts. An individual inserts a minimum of two lifting bolts through eyes of a blind flange work piece, which are supported along the ledge area of each claw on either side of the blind. The lip prevents the lifting bolts from inadvertently sliding off the distal end of the claw horizontal portion and off of the ledge region, whereby the lip 13 bears against any catch bolt and prevents dislodgement thereof.

When the device is not in use actively lifting a flange, the claws of the pipe flange lifting device rotate and open with ease. A user opens the claws 11 by rotating the claws 11 about the common pin 12. The connection between the pin 12 and the claws 11 may be assisted by a roller bearing or alternatively be directly connected. Gravity assists in facilitating the closing of the claws 11 into a stable position. The crane hoist attaches to the device above the pin 12 and does not affect the pivot functionality of the pin 12 or the rotation of the claws 11.

Referring now to FIG. 2, there is shown a perspective view of an exemplary embodiment of the present invention, wherein the L-shaped claws are shaped to improve stability and safety during use, while performing the same functions as the first embodiment design. Spacers 18 are provided along the pin 12 that joints the two opposing claws, while the hoist point 19 is rotated to align with the two claws 11. In this form, the claws 11 further prevent dislocation of the lifting pins during operation, and ensure a stable means of positioning a blind flange prior to installation. Along the diagonal of the L-shaped claws is a downward-facing protrusion. In the event the crane or similar lifting mechanism loosens its tension on the hoist point 19 and the claws disengage the lifting bolts, the claws protrusion will settle above one of the lifting bolts and prevent the claws from rotating from a lifting position. The protrusion forms a semi-enclosed cavity at the apex of the horizontal and diagonal member of the claw, whereby a lifting bolt is continually engaged until physically removed by a user. The user lifts this protrusion over the lifting bolt to remove the claw, whereby it may be rotated away from a lifting position.

Figure 3:
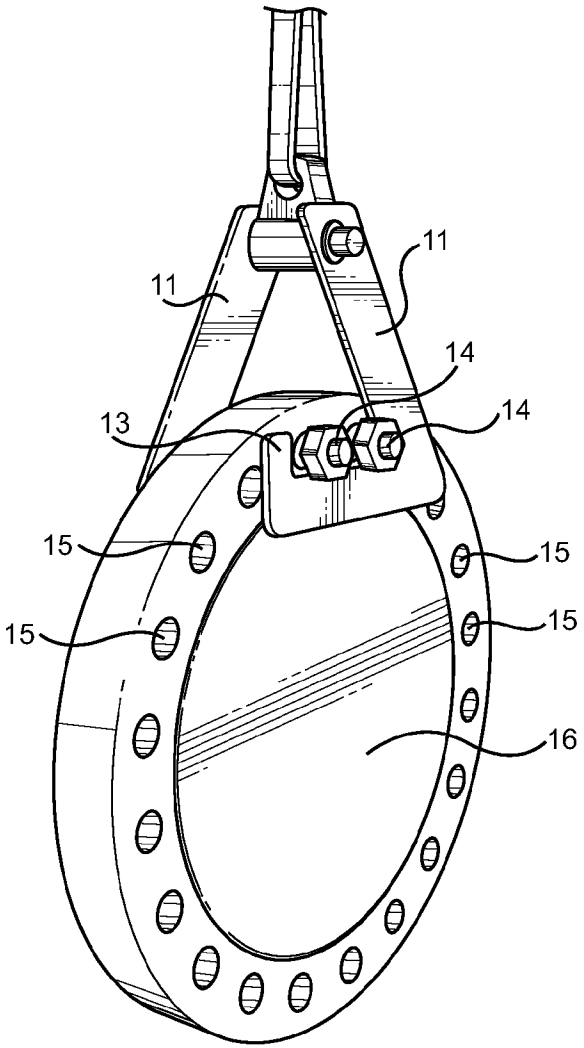
FIG. 3 is a perspective view of the present invention attached to a crane hoist and in use supporting a blind flange via two lift bolts.

Referring now to FIG. 3, there is shown a perspective view of the first embodiment of the present invention in use lifting a blind flange. The ledge area of the claws 11 hook beneath a set of lifting bolts 14 that an individual inserts into eyes 15 of the blind flange 16. The lifting bolts 14 are prevented from falling from the ledge via a lip 13 at the distal end of each horizontal portion, and further preventing the claws 11 from opening during lifting. The lifting bolts 14 serve as lift points such that the device can lift the blind flange and a crane or hoist can position the assembly in a position to be installed. The lifting bolts also serve as a means to align the blind flange 16 with a pipe opening to be covered.

To use the device, an individual inserts, at the minimum, a pair of bolts into two eyes of a blind flange. The use of two bolts allows for distribution of the weight of the blind flange over a greater area and also provides a safety mechanism—if for some reason one of the bolts is fails during operation, the second bolt will likely hold until the blind flange can be set down onto the ground safely. The claws of the device slide under the bolts on either side of the flange. An individual positions the device such that a portion of the blind flange fits in the space between the two claws, using spacers to achieve minimal clearance between the flange surfaces and the claws, while providing sufficient spacers to prevent pinch points due to claw inclination. As the claws are positioned, a user ensures that the lifting bolts are located within the triangular-shaped space within the claws and along the horizontal ledge provided thereon. The user lifts the crane hoist to place tension on the device, securing the claws for in a static configuration prior to lifting the assembly from the ground. The flange is then lifted and the lifting bolts are aligned with the receiving eyes of a pipe opening over which the flange is to be installed. Once the bolts align with the receiving holes, a user inserts additional bolts through the flange eyes and receiving eyes on the pipe opening before removing the device. The weight of the flange is then distributed among the installed bolts between the pipe end and the flange.

To remove the device, the crane hoist is lowered slightly, thereby relieving the claws of the flange weight and providing a clearance for the claw catches to pass beneath the lifting bolts. Since the flange is aligned with the target pipe opening and numerous bolts hold the two parts together, the device should no longer be bearing any of the weight from the blind flange. With that being the case, an individual opens the claws of the pipe flange lifting device such that the claws clear the bolts as the device moves away from the flange. The bolts can then be torqued into placed around the perimeter of the flange, which closes any clearance between the pipe end and the device necessary to fit the claws during alignment.

Figure 4:
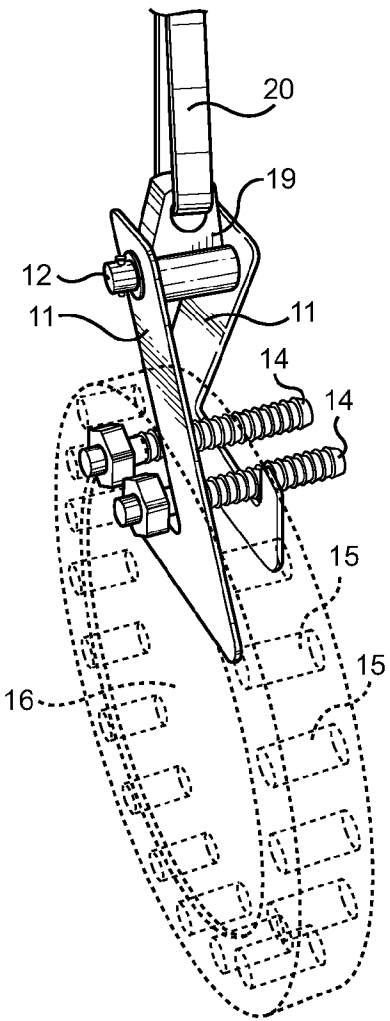
FIG. 4 is a perspective view of the present invention holding a blind flange by two lift bolts that have been inserted into two eyes of the blind flange during installation of the flange onto a pipe end.

Referring now to FIG. 4, there is shown a perspective view of the first embodiment of the present invention in use holding a blind flange while attached to a lifting apparatus. Two lifting bolts 14, which insert through eyes 15 of a blind flange 16, rest in the ledge areas of the claws 11. This view of the present invention is at an angle thereby depicting the action of the claws during operation, whereby the claws need support the lifting bolts on both sides of the blind flange to provide a stable platform for lifting and positioning the flange. The bolts undergo three-point bending and therefore must be sized to accommodate the weight of the flange and any operational loads during transportation.

The present invention connects to a lifting apparatus, such as a crane hoist 20, at the crane hoist fitting 19 attached to the common pin 12. The particular arrangement depicted in FIG. 4 is of a common pin that does not require spacers between the claws of the device. When a project requires the lifting and rigging of numerous blind flanges of fixed thickness, utilizing a common pin without a plurality of spacers simplifies the project and reduces the number of potential pinch points that exist along the pin. In the exemplary embodiment of the present invention, the pin is elongated and the hoist location is rotated to provide a greater degree of movement along the pin for each claw, therefore necessitating the use of spacers to prevent binding of the claws due to inclination or tilt thereof.

Figure 5:
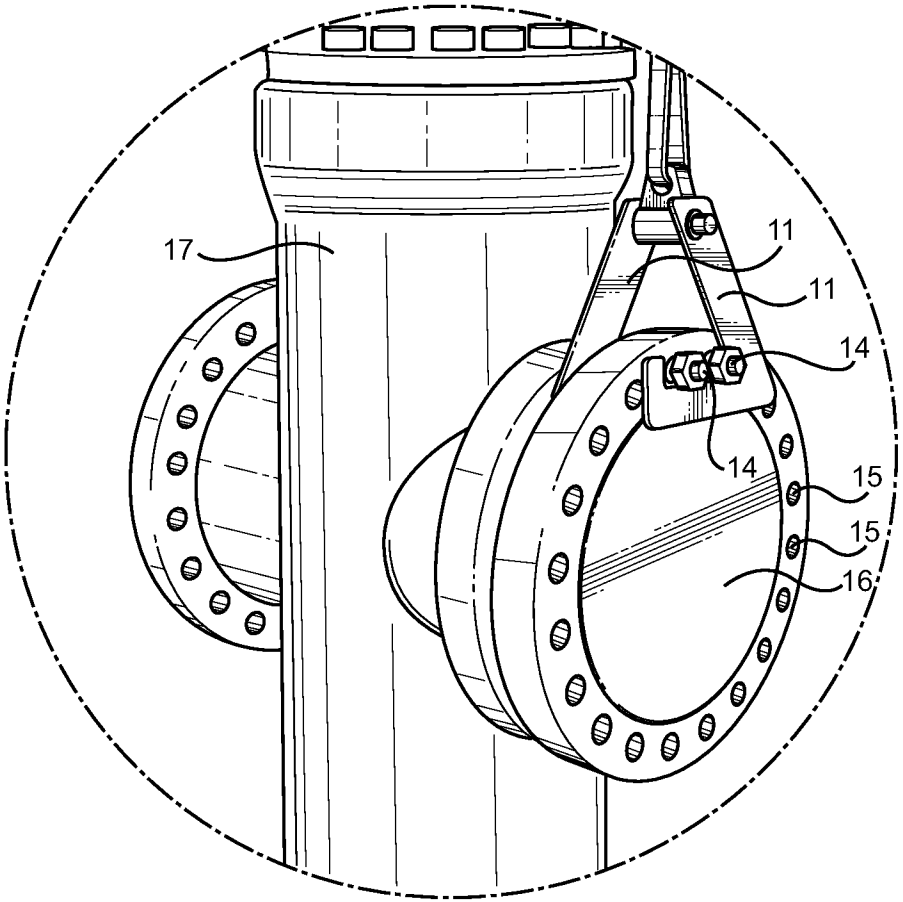
FIG. 5 is a perspective view of the present invention in use lifting and aligning a blind flange onto a pipe end prior to installation.

Referring now to FIG. 5, there is shown a perspective view of the first embodiment of the present invention in use aligning a blind flange with a pipe opening. A user guides the two bolts 14 serving as lift points into receiving eyes 15 of the pipe opening 17. The present invention is utilized to align the bolts with the receiving eyes and thus aligns the blind with the pipe opening. Once the guide lifting bolts are in place, a user inserts additional bolts through the remaining blind flange eyes and the receiving eyes of the pipe opening to further ensure proper connection of the blind to the assembly. A user then removes the device from the lifting bolts and the blind flange, whereby welding of the blind flange to the pipe opening may commence.

While the embodiments of the present invention are specifically suited and intended to lift blind flanges, the present invention is not desired to be limited to lifting only such devices. The present invention may further be used to lift and rig a wide variety of other flange types, including, but not limited to, larger weld neck flanges, slip-on flanges, socket weld flanges, threaded flanges, lap joint flanges, ring joint flanges or tongue and groove flanges, presuming that the mechanism for lifting these other flange types can be safely facilitated by using the two bolt lifting point method described above.

The improved, triangular-shaped flange lifting device for lifting and rigging flanges during the fabrication improves user safety and facilitates the alignment of a blind flange with a pipe fitting, without requiring awkward fittings or hazardous methods that compromise safety and the effectiveness of the workers. By enabling a user to align the bolts, there is no need to reorient the flange prior to inserting bolts through a plurality of eyes to initiate connection. The device incorporates two opposing claws, which catch a pair of lifting bolts inserted through the eyes of a flange. One claw catches the lifting bolts in the ledge area of the claw horizontal region on either side of the flange. The bolts serve as lifting points and, with the assistance of a lifting means, such as a crane hoist or forklift, the device assists positioning such flanges into place for installation on a pipe opening. The present invention further eliminates the need to weld a lifting eye onto the flange, which is a costly endeavor. Instead, the present invention allows for the flange to be lifted directly by the lifting bolts, which will then be used to secure the flange to the pipe opening.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe flange lifting device, comprising:

a set of generally L-shaped claws separated by a given offset distance;

each of said claws having a diagonal and a horizontal portion, said diagonal portion of each claw being rotatably attached to a pin spanning said offset distance between claws;

said horizontal portion further comprising a ledge area adapted to support a pair of lifting bolts and having an upstanding catch disposed at its distal end;

said pin having crane hoist fitting at its midpoint for connecting said device to a lifting apparatus;

a plurality of spacers along said pin between said crane hoist fitting and said claws to adjust said offset distance and prevent pinch points.

2. The device of claim 1, wherein said pin separates from said claws for the purpose of adding or removing said spacers.

3. The device of claim 1, wherein said device has two configurations; a lifting configuration wherein said device has an overall triangular shape, and an open configuration wherein said claws pivotally rotate around said common pin as said claws are pulled outward away from one another.

4. The device of claim 1, wherein said ledge area is coated with a material to preventing damage to said lifting bolts during use.

5. The device of claim 4, wherein said material is a high density rubber.

6. The device of claim 1, wherein said claw diagonal portion further comprises a protrusion forming a semi-enclosed cavity at the apex of said L-shaped claw, adapted to engage a lifting bolt upon slacking said lifting apparatus and prevent rotation of said claws.

* * * * *